US005333009A

United States Patent [19]

Gell, Jr. et al.

[11] Patent Number: 5,333,009

[45] Date of Patent: Jul. 26, 1994

[54] METHOD AND APPARATUS FOR INDUCING REFLEX BLINK REACTIONS

[76] Inventors: Harold A. Gell, Jr., 13720 Lockdale Rd., Silver Spring, Md. 20906-2117; Constantine Haralambopoulos, 709 English Rd., Rochester, N.Y. 14616

[21] Appl. No.: 102,224

[22] Filed: Aug. 5, 1993

[51] Int. Cl.[5] ..... A61H 1/02

[52] U.S. Cl. ..... 348/61; 345/112; 601/37

[58] Field of Search ..... 128/25 A; 348/61, 578; 345/112

[56] References Cited

U.S. PATENT DOCUMENTS 3,923,044 12/1975 Miller ..... 128/25 A
5,051,931 9/1991 Chen et al. ..... 128/25 A X
5,099,829 3/1992 Wu ..... 128/25 A X

*Primary Examiner*—Mark R. Powell
*Attorney, Agent, or Firm*—Harold A. Gell, Jr.

[57] ABSTRACT

A method and apparatus for triggering the reflex blink reaction of a person using a computer terminal display. Blinking is triggered by a macro shift in the dominant object viewed by the person. The macro shift may be in the form of foreground/background reversal, display color changes, blank screen, etc. caused by hardware switching means or programed ANSI escape sequence changes.

31 Claims, 2 Drawing Sheets

METHOD AND APPARATUS FOR INDUCING REFLEX BLINK REACTIONS

FIELD OF THE INVENTION

A computer display control system for inducing reflex blink reactions in computer display terminal users.

BACKGROUND OF THE INVENTION

The ever increasing use of computer terminals in the work place and as a means for entertainment has resulted in a corresponding increase in eyestrain, eye irritation, and general eye discomfort in computer users. Many attempts have been made to solve this problem. The attempts include the use of non-glare screens and various color combinations of the display. All of these attempts have failed.

Recent exhaustive studies by the medical profession of the aforementioned problem have resulted in a breakthrough with respect to understanding the problem. Medical investigators have determined that a computer user staring at a display terminal blinks at a rate which is significantly below the norm for that individual. This reduction in the rate at which a person blinks causes a corresponding reduction in the frequency at which the eye is cleansed and bathed by secretions from the tear duct. This leads to a dry eye syndrome manifested as discomfort, irritation and fatigue. In extreme cases, the irritation can lead to more serious problems affecting the health of the eyes.

One factor leading to the reduced blink syndrome is that a video display terminal changes on a micro level as single letters or numbers are added to the screen by an operator. This creates a gradual or micro change to the visual field which will not stimulate a blink response. What is required to cause reactive blinking is a sudden change in the visual field on a macro level such as might be caused by a strobe light.

OBJECTIVES OF THE INVENTION

It is a primary objective of the present invention to provide a means to trigger a computer display terminal user's automatic blink reflex.

Another objective of the present invention is to provide a means to control the rate at which a computer terminal user blinks.

A still further objective of the present invention is to provide a visual stimulus for a computer terminal user which will create a reflex blink reaction in the terminal user.

A still further objective of the present invention is to provide a means for controlling a stimulus created in association with a computer display terminal which will cause the automatic blink of a user's eye.

Another objective of the invention is to provide an embedded program which will periodically alter the ANSI escape sequence affecting the terminal display characteristics.

A still further objective of the invention is to provide an adjustable switching means for periodically causing reversal of the video in a terminal display.

Another objective is to provide a means for changing the display screen attributes to effect a periodic macro shift in the image presented by the display.

A further objective is to provide a switching means for periodically switching a video display from standard to reverse or visa versa.

SUMMARY OF THE INVENTION

The present invention provides a method and apparatus for reducing eyestrain and eye irritation resulting from prolonged use of a computer terminal visual display and the attendant blink rate reduction. The display user is caused to blink at a controlled rate which in a preferred embodiment approximates the normal blinking rate for the individual by manipulation of the visual impact of the computer display on the user, i.e. a reflex blinking reaction is triggered by variations in the visual display being used by the subject. These variations may include one or more of the following: video reversal, contrast shifts, illumination intensity shifts, format shifts, and/or subject matter shifts. These shifts are all of a visually discernible nature but may be presented for a duration which is subliminal. In addition to the visual stimulus contemplated by this invention, it is contemplated that the blinking reflex may be instigated by pressure fronts created in the form of a blast of air or a sonic front generated by a subaudible tone of a very brief and sharp nature.

DETAILED DESCRIPTION OF THE INVENTION

Figure 1:
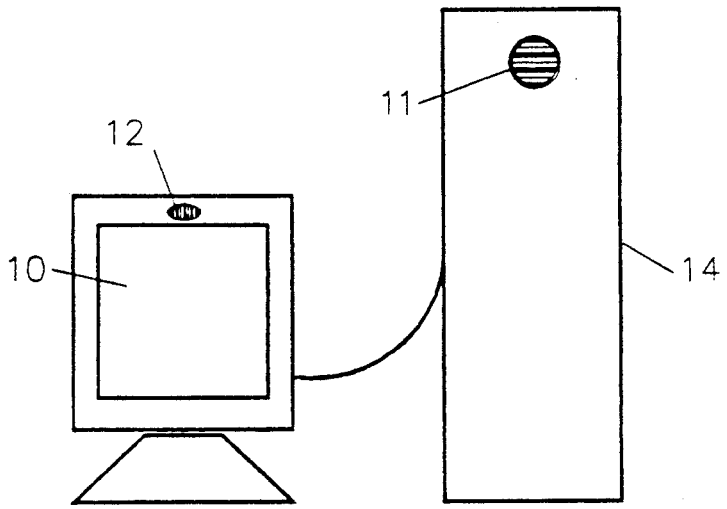
FIG. 1 illustrates a typical computer terminal.

In a conventional computer terminal such as illustrated in FIG. 1, a visual display means 10 provides graphic information that the operator constantly views while operating the terminal. The constant viewing causes a relative immobilization of the eye so that it does not experience the normal relative movement with respect to the eyelids and tear ducts. The image field remains relatively constant and unchanging except for micro changes resulting from adding letters and numbers to the screen one at a time. These micro changes in the image field do not induce reactive blinking which further diminishes the amount of relative movement between eyelids and the eye thus leading to drying of the eye and discomfort and other physical problems as previously discussed.

In various embodiments of the invention, operation of the screen 10 is altered to effect a macro change in the visual presentation, i.e. the operator's field of view. As used throughout this patent, the term macro refers to a change in the field of view which is of a magnitude that will cause an involuntary blink response. This change is of short duration so as not to interfere with operation of the terminal and it is repeated at a rate which is adjustable and which may approximates the normal blink rate of an individual not under the duress of staring at a computer terminal. The brief, repetitive macro image changes may be of a duration which is barely discernible or the period of change may be subliminal so as not to affect the operator's function at the computer workstation.

In a preferred embodiment, a blink inducing macro change to the display is achieved via the computer operating system. For purposes of explanation, assume the computer is running under MS-DOS. A time dependent repeating program is embedded in the program being run using any of the well known programming techniques whereby the screen attributes are periodically switched by an ANSI escape sequence. In this embodiment, assume that the system default is white text or foreground with a black background. An embedded command, ESC[7m, changes the display from the default to black text on a white background. After an interval which may be so short that the change is not apparent to the user (subliminal), a command of ESC[0m is given to switch the display back to the default mode. The timing between the ESC[7m and following ESC[0m sequence is controlled by a timing routine which is selected to be most compatible with the primary program or programming language being used. For consistency, the time between non-standard and return to default video commands is referred to as the "blink duration". The two escape sequences, blink duration, are repeated at a rate, herein after referred to as "blink rate", which may be based on the system clock or other internal timing functions. A primary criterion for selecting a timing routine for both the blink duration and blink rate is that the periods are controllable.

If the automatic repetitive blink stimulating operation of the forgoing embodiment is unacceptable in a work environment, an alternate embodiment may be implemented which allows a terminal operator to activate a blink stimulation whenever desired. In this embodiment, a key from the keyboard which is not normally used is programed to activate a blink duration. So instead of combining the blink duration sequence with a blink rate command, the blink duration is combined with a key assignment. Thus every time the operator depresses the assigned key, a blink duration sequence occurs.

The macro change to the field of view may manifest itself by any one of a variety of means. The previous two embodiments use reverse video or image reversible by implementing the reverse video ANSI command 7m and return to default command 0m. This combination of attribute shifts is primarily for a monochrome monitor. If a color monitor is being used, other screen attribute changes may be used to cause macro shifts in the field of view. By way of example, the following is a listing of ANSI screen attribute codes and related colors for foreground and background that may be combined to create macro shifts to the field of view, i.e. the display screen.

The following attributes specify text or foreground color:

30 Black
31 Red
32 Green
33 Yellow
34 Blue
35 Magenta
36 Cyan
37 White
7 Black text on a white background The following attributes specify background color:

40 Black
41 Red
42 Green
43 Yellow
44 Blue
45 Magenta
46 Cyan
47 White
7 Black text on a white background In the forgoing embodiments, the blink duration and if applicable the blink rate are adjusted by program manipulation, the specific type of which is dependent on the program in which the screen attribute change commands are embedded.

Figure 2:
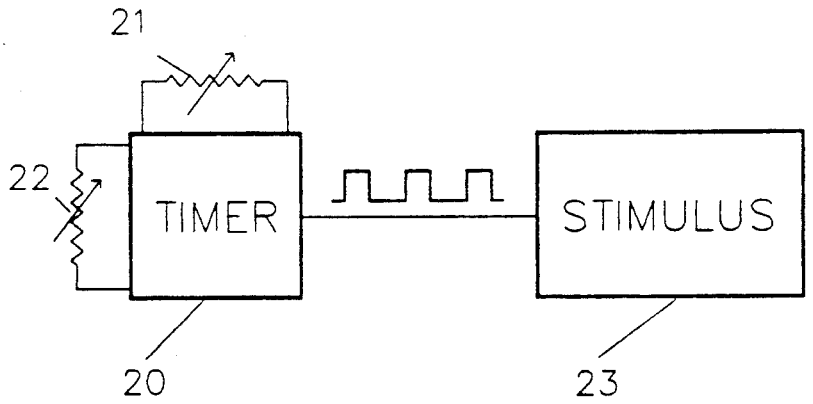
FIG. 2 is a simplified block diagram illustrating a means to control the blink inducing stimulus.

In addition to creating macro field of view shifts via programming, the same effect can be obtained by manipulating the image reversal switch found on most computer monitors. In this form of the invention, the reverse video switch of the monitor is paralleled by or replaced by an electronic switch driven by a timer as illustrated in FIG. 2. The timer 20 produces a pulse train in which the pule width and repetition rate are controlled by separate potentiometers 21 and 22 or by electronic delay or counting means. The pulse width produces the blink duration and the pule repetition rate is the blink rate. In cases where a monitor is designed without a video reversal circuit, one is added. In the later case, pulsed operation may be designed into the circuit or added as a control input.

In an alternate embodiment, the macro shift in the field of view is created by defocusing the image on the display means. In this embodiment, the defocusing must be at such a great magnitude that the overall effect is a macro shift in the image as viewed by the observer. This is achieved by a timing circuit as illustrated in FIG. 2 but instead of a video polarity or attribute control means, means 23 represents the focus control circuit. In this embodiment, each time a pulse from the timer 20 is applied to the focus control means the focus voltage level is changed by an amount sufficient to defocus the foreground images on the monitor to the extent that the area of foreground imagery increases to the extent that it constitutes a macro change in the display.

In another alternate embodiment, the macro shift in the field of view is created by switching off the image or foreground by interrupting the video input to the monitor. This is achieved by a timing circuit as illustrated in FIG. 2 wherein means 23 represents a switching means controlling the video input to the monitor.

Figure 4:
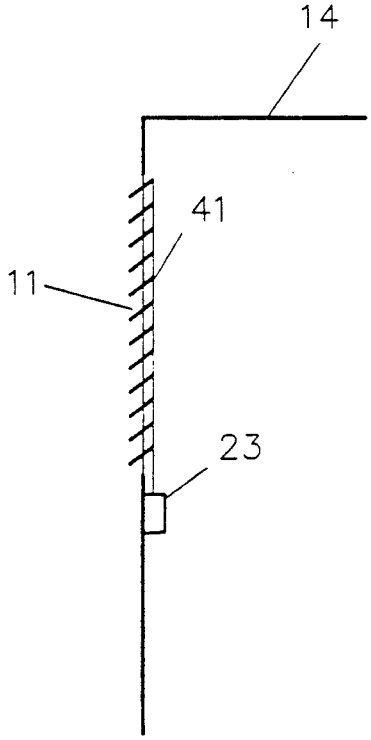
FIG. 4 is a cutaway view of a louvered exhaust vent on a force ventilated electronic components housing.

In a still further embodiment of the invention, a pressure wave is directed toward the face of the terminal operator to cause the involuntary blink stimulus. The pressure wave may be created by a blast of air emanating from an area immediately in front of the operator's face such as the duct 11 in front of the terminal case 14. In this embodiment, the case is pressurized by a cooling fan. The duct is normally closed by an electromagnetically operated series of shutters similar to the focal plane shutter of a camera. Upon receiving a pulse from the timer 20 of FIG. 2, electromagnetic means 23 opens the louvers 41 of FIG. 4 which allows the cooling air normally circulating within the equipment case to escape in a direction calculated to cause the blast of air to strike the operator's face. After a brief instant, the shutters are closed until the next pulse which stimulates another blink. Ideally, the air source is off to one side but in front of the operator so that glasses being worn by the operator will not interfere with the short pulse of air.

Figure 3:
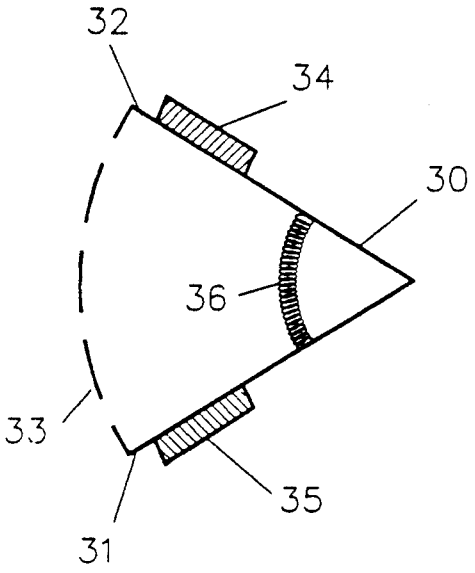
FIG. 3 is a side view of an electromagnetically controlled bellows.

In a further modification of this embodiment, a bellows like pouch is electromagnetically closed by the pulses produced by timing means 20 of FIG. 2. The bellows, 30 of FIG. 3, is flat, closed at one end and opened at the other. It is positioned so that when snapped shut, air is forced out of the open end 33 as a brief blast or pulse of a volume calculated to cause reflex blinking of the operator. A typical location is 12 of FIG. 1. The device is a simple closed pouch having an accordian-like shape wherein the top and bottom members 31 and 32 are closed at one end and both sides and open at end 33. Magnetically responsive members 34 and 35 are positioned on opposite sides of the pouch so that when at least one is stimulated by an electric current causing it to become an electromagnet, the pouch is slammed shut, forcing all the air within the pouch to be expelled. The pouch is normally held open by magnetic force or a spring means 36.

In a still further embodiment of the invention, a sonic transducer is positioned in front of the operator, typically on the top of the display means as indicated by transducer 12 in FIG. 1. In operation, a pulse from the timer 20 of FIG. 2 is applied to the stimulus 23 which may be an audible or subaudible sonic transducer 12 which creates a brief sound wave pulse calculated to apply enough pressure to the terminal operator's face and eyes as to stimulate the reflex blink reaction.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What is claimed is:

1. A method for reducing the eye irritation in video terminal users, including the steps of:

stimulating the involuntary reflex blinking response of a person observing the display of a video terminal monitor; and said step of stimulating said involuntary reflex blinking response includes the step of creating a stimulus, selected from the group comprising visual, audible, subaudible, or tactile stimuli which cause the involuntary reflex blinking of said person.

2. A method as defined in claim 1, including the further steps of repeating the generation of said stimulus at a repetition rate set by a control means.

3. A method as defined in claim 1 wherein said stimulus is sustained over a period of time which renders it discernible by said operator.

4. A method as defined in claim 1 wherein said stimulus is sustained over a period of time which is so short that it is not discernible by said operator.

5. A method as defined in claim 1 wherein said stimulus is sustained for a period of time which causes it to be subliminal.

6. A method as defined in claim 1 wherein said stimulus comprises an image reversal of said display.

7. A method as defined in claim 1 wherein said stimulus comprises a color shift of the background of said display.

8. A method as defined in claim 1 wherein said stimulus comprises a color shift of the foreground of said display.

9. A method as defined in claim 1 wherein said stimulus comprises defocusing of the foreground image on said display to the extent that it creates a macro reduction in the background of said display.

10. A method as defined in claim 1 wherein said stimulus is a puff of air directed at the operator's face.

11. A method as defined in claim 1 wherein said stimulus is a sonic pulse.

12. A method as defined in claim 1 wherein said stimulus is a subaudible sonic pulse.

13. An apparatus for stimulating the involuntary reflex blinking of an individual observing a display terminal monitor, comprising:

means for generating a control signal; and means responsive to said control signal for creating a stimulus directed at said individual, said stimulus selected from the group comprising visual, subaudible, audible, or tactile stimuli which cause the involuntary blink of said individual.

14. An apparatus as defined in claim 13 wherein the control signal created by said means for generating a control signal comprises a first element which initiates said stimulus and a second element which terminates said stimulus.

15. An apparatus as defined in claim 14 wherein the time duration between said first element and said second element is adjustable.

16. An apparatus as defined in claim 15 wherein said means for generating said control signal produces a series of said control signals with each of said control signals spaced in time an adjustable duration from the proceeding one of said control signals.

17. An apparatus as defined in claim 13 wherein said means responsive to said control signal for creating a stimulus comprises:

means for switching the video reversal circuit of said monitor.

18. An apparatus as defined in claim 13 wherein said means responsive to said control signal for creating a stimulus comprises:

an exhaust opening in a component of said terminal which is pressurized by a cooling fan;

a louvered closure for said exhaust opening; and electromagnetic means for opening and closing said louvered closure in response to said control signal.

19. An apparatus as defined in claim 13 wherein said means responsive to said control signal for creating a stimulus comprises a transducer for creating a subaudible sound wave.

20. An apparatus as defined in claim 13 wherein said means responsive to said control signal for creating a stimulus comprises a transducer for creating an audible sound wave.

21. An apparatus as defined in claim 13 wherein said means responsive to said control signal for creating a stimulus comprises circuit means for changing the voltage of the focus control means of said monitor.

22. An apparatus as defined in claim 13 wherein said means responsive to said control signal for creating a stimulus comprises:

a bellows normally biased open; and electromagnetic means responsive to said control signal for collapsing said bellows whereby a quantity of air is ejected from said bellows toward said individual.

23. An apparatus as defined in claim 13 wherein said means responsive to said control signal for creating a stimulus comprises switching means for interrupting the video input to said monitor.

24. A method for reducing eye fatigue of a person using a computer terminal video display monitor by inducing a reflex blink reaction in said person, including the steps of:

changing the screen attributes of said monitor to effect a change in the output of said monitor which is of a magnitude that will cause an involuntary blink reaction in said person; and returning the screen attributes to a default setting.

25. A method as defined in claim 24, including the further steps of:

repeating said steps of changing and returning said screen attributes to effect a desired blink repetition rate.

26. A method as defined in claim 24 wherein said step of changing said screen attributes switches the display of said monitor from light foreground and dark background to dark foreground and light background.

27. A method as defined in claim 24 wherein said step of changing said screen attributes switches the display of said monitor from dark foreground and light background to light foreground and dark background.

28. A method as defined in claim 24 wherein said step of changing said screen attributes switches the display of said monitor from white foreground and black background to black foreground and white background.

29. A method as defined in claim 24 wherein said step of changing said screen attributes switches the display of said monitor from black foreground and white background to white foreground and black background.

30. A method as defined in claim 24 wherein said step of changing said screen attributes changes the background color of said display.

31. A method as defined in claim 24 wherein said step of changing said screen attributes changes the foreground color of said display.

* * * * *